US005791321A

United States Patent [19]

Kondoh

[11] Patent Number: 5,791,321

[45] Date of Patent: Aug. 11, 1998

[54] FUEL SUPPLYING APPARATUS FOR INTERNAL COMBUSTION ENGINE

[75] Inventor: Shinya Kondoh, Toyota, Japan

[73] Assignee: Toyota Jidosha Kabushiki Kaisha, Toyota, Japan

[21] Appl. No.: 868,347

[22] Filed: Jun. 3, 1997

[30] Foreign Application Priority Data

Jun. 6, 1996 [JP] Japan ..... 8-144425

[51] Int. Cl.[6] ..... F02M 25/08; F02M 37/08; F02D 41/14

[52] U.S. Cl. ..... 123/698; 123/458; 123/497; 123/520

[58] Field of Search ..... 123/458, 490, 123/497, 520, 698

[56] References Cited

U.S. PATENT DOCUMENTS

| | | | |
|---|---|---|---|
| 4,565,173 | 1/1986 | Oshiage et al. | 123/458 |
| 4,641,623 | 2/1987 | Hamburg | 123/520 X |
| 4,703,737 | 11/1987 | Cook et al. | 123/520 |
| 5,048,492 | 9/1991 | Davenport et al. | 123/520 |
| 5,143,040 | 9/1992 | Okawa et al. | 123/684 |
| 5,586,539 | 12/1996 | Yonekawa et al. | 123/458 |

FOREIGN PATENT DOCUMENTS 6-173805 6/1994 Japan .

*Primary Examiner*—Tony M. Argenbright
*Attorney, Agent, or Firm*—Kenyon & Kenyon

[57] ABSTRACT

An fuel supplying apparatus for supplying a fuel to an internal combustion engine. The engine has a plurality of injectors for injecting fuel to the engine, a pump for supplying fuel from a fuel tank to the injectors and a fuel vapor treating device that collects fuel vapor generated in a fuel tank and treats the vapor without releasing it into the atmosphere. An electronic control unit (ECU) controls the injectors for adjusting an opening time period of the injectors depending on the running condition of the engine to control the amount of fuel to be injected from the injectors. The ECU also controls the pump for adjusting the amount of fuel to be discharged from the pump depending an the running condition of the engine to control the pressure of the fuel to be pumped to the injectors. The ECU reduces the opening time period of the injectors to reduce the amount of fuel to be injected from the injectors when the fuel vapor is supplied to the engine by the treating device. The ECU also reduces the amount of fuel to be discharged from the pump so as to further reduce the amount of fuel to be injected from the injectors.

13 Claims, 8 Drawing Sheets

FUEL SUPPLYING APPARATUS FOR INTERNAL COMBUSTION ENGINE

BACKGROUND OF THE INVENTION

1. Field of the Invention

The present invention relates to an apparatus for supplying fuel to an internal combustion engine. More particularly, the present invention pertains to an apparatus for controlling the amount of fuel discharged from the injector in accordance with the operating state of the engine.

2. Description of the Related Art

There is a known fuel vaporizing apparatus to be provided in an engine. In this apparatus, fuel vapor formed in a fuel tank is collected into a canister, and the thus collected fuel is purged from the canister to an intake passage of the engine. The fuel purged into the intake passage is supplied to a combustion chamber of the engine and burned.

There is also a known apparatus for controlling air-fuel ratio of a gaseous mixture of the air and fuel to be supplied to the combustion chamber of the engine. In this apparatus, a computer computes an air-fuel ratio required depending on the engine speed, the engine load and the temperature of the engine. The computer controls the air-fuel ratio of the gaseous mixture by correcting the amount of fuel supplied from injectors to the combustion chambers such that the actual air-fuel ratio detected by a sensor coincides with the required air-fuel ratio. Such control achieves optimization of output characteristics, discharge characteristics and performance of the engine under various running conditions.

When an engine having such fuel vaporizing apparatus is subjected to air-fuel ratio control, purge fuel is supplied to the combustion chambers in addition to the fuel supplied from injectors. Accordingly, the air-fuel ratio control should be performed taking the purge fuel into consideration.

Japanese Unexamined Patent Publication No. Hei 4-112959 discloses an apparatus that controls the air-fuel ratio taking the amount of fuel to be purged to the intake passage into consideration. In this apparatus, as shown in FIG. 7, each injector 82 provided in an engine 81 injects fuel into a corresponding combustion chamber 83. The pressure of the fuel supplied to each injector 82 is constantly maintained at a fixed level. A canister 84 collects fuel vapor formed in a fuel tank 85 through a vapor line 86. A purge line 87 extending from the canister 84 communicates with an intake passage 88 of the engine 81. An electromagnetic valve 89 provided in the purge line 87 controls the amount of fuel flowing through the line 87.

An electronic control unit (ECU) 90 computes the amount of fuel to be injected from each injector 82 depending on the running state of the engine 81. The ECU 90 computes a correction coefficient with respect to the air-fuel ratio such that the actual air-fuel ratio to be detected by an oxygen sensor 91 coincides with the theoretical, or target, air-fuel ratio. The ECU 90 corrects the amount of fuel to be injected from the injectors 82 based on the thus obtained correction coefficient.

The ECU 90 opens the valve 89 to allow the negative pressure existing in the intake passage 88 to act upon the purge line 87 and the canister 84 during operation of the engine 81. This negative pressure causes purging of the fuel in the canister 84 through the purge line 87 into the intake passage 88. The ECU 90 computes the amount of fuel to be purged based on the air-fuel ratio correction coefficient. The ECU 90 adjusts the position of the valve 89 to correct the amount of purge fuel. The ECU 90 makes a predetermined correction in the amount of fuel injected from each injector 82 depending on the amount of the purge fuel and further corrects the corrected injection value depending on the correction of the amount of the purge fuel.

The ECU 90, when the amount of purge fuel is to be increased, reduces the amount of fuel injected from each injector 82. The ECU 90 adjusts the valve opening time of the injectors 82 to adjust the fuel injection amount. More specifically, the ECU 90 extends the valve opening time of the injector 82 so as to increase the fuel injection amount and reduces the valve opening time to reduce the fuel injection amount. This valve opening time is substantially the same as the energization time of the injectors 82.

The injection characteristic curve of one of the injectors 82 is shown in the graph of FIG. 8. Problems may occur when the valve opening time of the injectors 82 is controlled based on this characteristic curve. In this graph, the abscissa represents "valve opening time" of the injector, while the ordinate represents the amount of fuel to be injected from the injector 82 ("fuel injection amount"), and the pressure of the fuel to be supplied to the injectors 82 is maintained at a constant level. While the relationship between the valve opening time and the fuel injection amount is generally directly proportional, the proportional relationship tends to deteriorate when the valve opening time is shorter than a predetermined value T1. In the range of valve opening times longer than the predetermined value T1, the fuel injection amount can be accurately adjusted in relation to the increase in the amount of purge fuel. However, the fuel injection amount cannot be adjusted accurately in relation to the increase in the amount of purge fuel in the range of valve opening time shorter than the predetermined value T1. Accordingly, in this lower range, the air-fuel ratio of the gaseous mixture cannot be controlled accurately.

SUMMARY OF THE INVENTION

The present invention was accomplished in view of the circumstances described above, and it is an objective of the invention to provide a fuel supplying apparatus for an engine that achieves appropriate control of the air-fuel ratio in the engine when fuel vapor formed in a fuel tank is purged to the engine.

It is another objective of the invention to provide a fuel supplying apparatus for an engine that achieves high-accuracy control of the air-fuel ratio regardless of the injection characteristics of the injectors.

To achieve above objectives, the present invention provides a fuel supplying apparatus for an internal combustion engine. The engine has a fuel injector, a pump and a treating device. The injector is selectively opened and closed based on the running condition of the engine. The pump supplies fuel from a fuel tank to the injector. The treating device collects fuel vapor formed in the fuel tank to supply it to the engine. The amount of fuel injected from the injector is adjusted depending on the running condition of the engine. The apparatus includes a running condition detector for detecting the running condition of the engine, an injector controller for adjusting an opening time period of the injector depending on the detected running condition to control the amount of fuel to be injected from the injector, a pump controller for adjusting the amount of fuel to be discharged from the pump depending on the detected running condition to control the pressure of the fuel to be pumped to the injector, an injection corrector for reducing the opening time period of the injector to reduce the amount of fuel to be injected from the injector, and a fuel pressure corrector for reducing the amount of fuel to be discharged from the pump so as to further reduce the amount of fuel to be injected from the injector.

Other aspects and advantages of the invention will become apparent from the following description, taken in conjunction with the accompanying drawings, illustrating by way of example the principals of the invention.

BRIEF DESCRIPTION OF THE DRAWINGS

The invention, together objects and advantages thereof, may best be understood by reference to the following description of he presently preferred embodiments together with the accompanying drawings.

DETAILED DESCRIPTION OF THE PREFERRED EMBODIMENT

An embodiment of a fuel supplying apparatus according to the present invention will hereafter be described with reference to the drawings.

Figure 1:
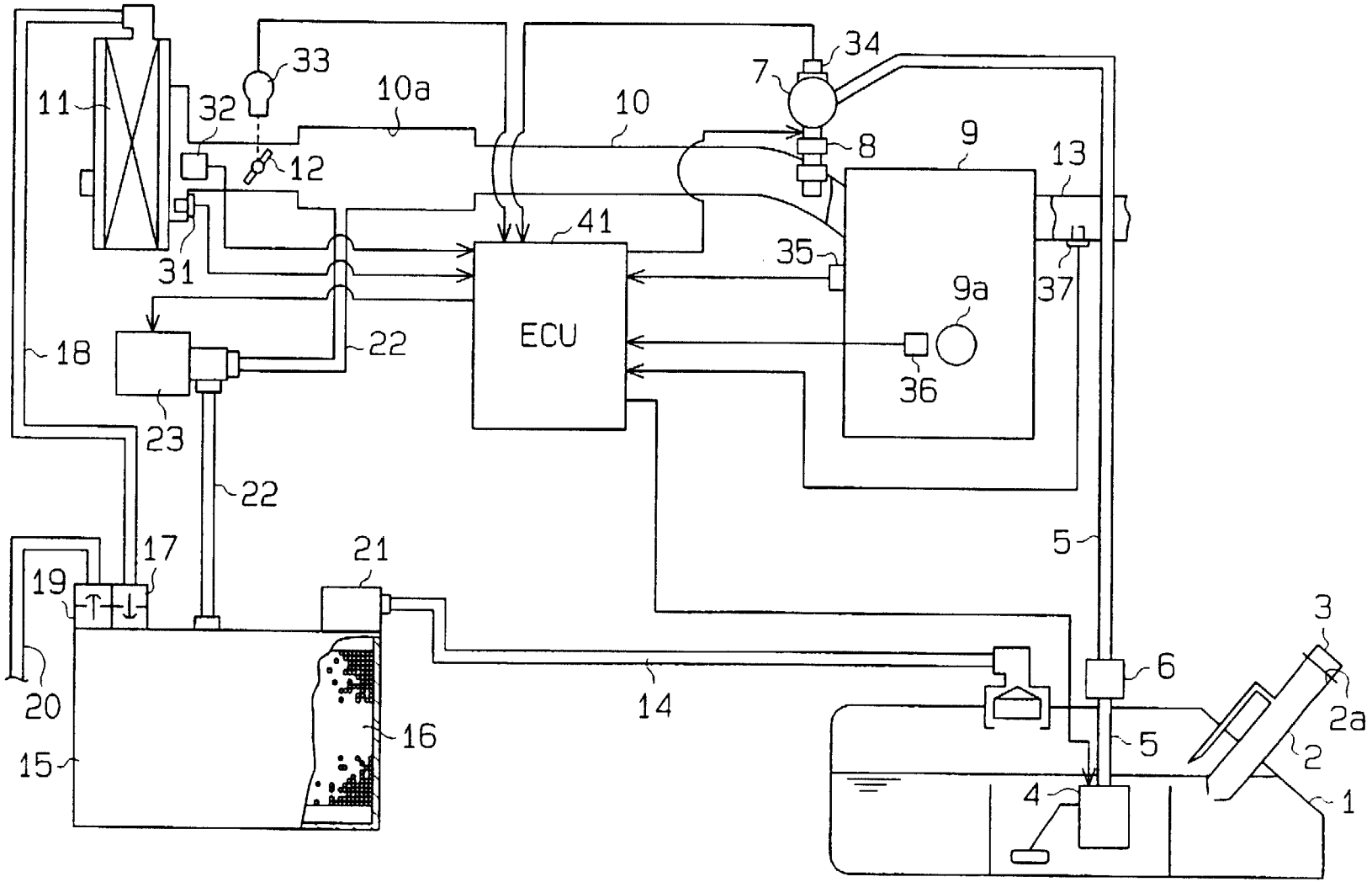
FIG. 1 is a diagrammatic view showing the structure of a fuel supply apparatus according to the present invention.

Referring to FIG. 1, a gasoline engine system of a vehicle has a fuel tank 1 in which fuel is reserved. The tank 1 includes a filler pipe 2 for filling the tank 1 with fuel. The pipe 2 has a filler hole 2*a* into which a fuel nozzle (not shown) is inserted during refueling of the tank 1. The filler hole 2*a* is closed by a removable cap 3.

An electric pump 4, which is provided in the fuel tank 1, incorporates a D.C. motor (not shown). When the motor is actuated, the pump 4 draws fuel from the tank 1 and discharges the fuel. The amount of fuel discharged from the pump 4 is determined by the value of the electric current flowing through the motor. In other words, the discharged fuel amount depends on the rotating speed of the motor.

A fuel line 5, which extends out of the tank 1, leads into a fuel filter 6 and further leads to a delivery pipe 7. A plurality of injectors 8 are provided in the delivery pipe 7. Each injector 8 corresponds to one of a plurality of cylinders of an engine 9. Each injector 8 includes a nozzle having an electromagnetic valve that is opened when energized and closed when de-energized.

Figure 8:
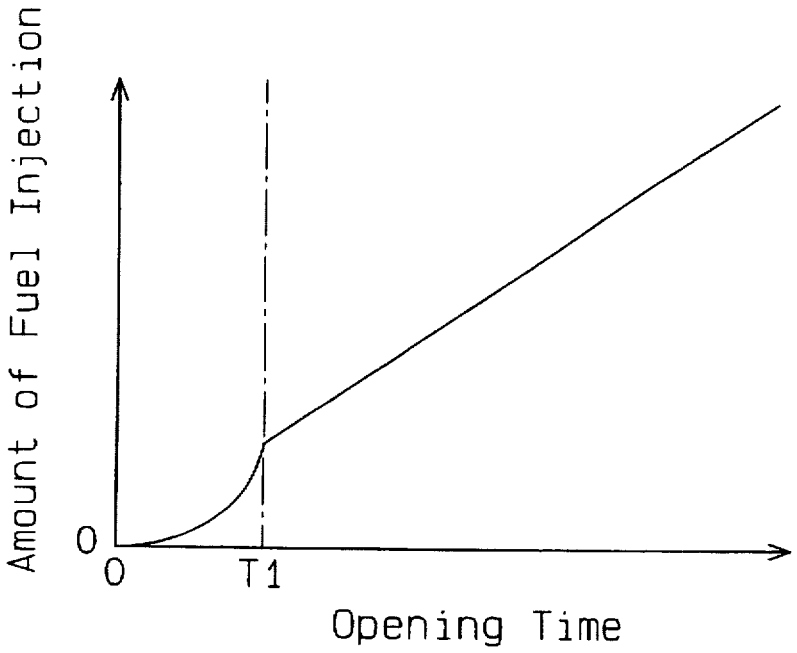
Fig.8 (Prior Art)
FIG. 8 is a graph illustrating a known characteristic curve of an injector.

In this embodiment, the injection characteristic curve of the injectors 8 is substantially the same as that of the conventional injector shown in FIG. 8, and the valve opening time and the fuel injection amount are generally directly proportional to one another. However, this proportional relationship to tends to deteriorate when the valve opening time is shorter than a predetermined value.

Air is drawn into the cylinders of the engine 9 through an intake passage 10 connected to the engine 9. The intake passage 10 includes an air cleaner 11 and a surge tank 10*a*. Air flows through and is cleaned by the air cleaner 11. A throttle valve 12 is provided in the intake passage 10. The throttle valve 12 is linked to an acceleration pedal (not shown). Manipulation of the acceleration pedal causes the throttle valve 12 to selectively open and close the intake passage 10. The opening area of the throttle valve 12 (throttle opening amount TA) is controlled to adjust the amount of air drawn into the cylinders (intake air amount Q).

The pump 4 pressurizes and sends the fuel from the tank 1 through the filter 6 and to the delivery pipe 7. The fuel is distributed to the injectors 8 in the delivery pipe 7. When opened, each injector 8 injects fuel into the corresponding cylinder. Combustion of the air-fuel mixture of the injected fuel and the air drawn in through the intake passage 10 rotates the crankshaft 9*a* of the engine 9. The exhaust gas produced during combustion is emitted into the atmosphere from the cylinders of the engine 9 through an exhaust passage 13.

The fuel vapor treating device has a canister 15 to collect vaporized fuel flowing through the vapor line 14. The canister 15 is filled with an adsorbent 16 comprised of activated carbon or the like.

A first atmospheric valve 17, which is a check valve, is provided in the canister 15. The atmospheric valve 17 opens when the interior pressure of the canister 15 becomes smaller than the atmospheric pressure by predetermined value. When opened, the atmospheric valve 17 allows atmospheric air to be drawn into the canister 15 while preventing a reverse flow of gas. An air pipe 18 extending from the atmospheric valve 17 is connected to a position near the air cleaner 11. This structure enables atmospheric air, purified by the air cleaner 11, to be drawn into the canister 15.

The canister 15 is also provided with a second atmospheric valve 19, which is also a check valve. The atmospheric valve 19 opens when the interior pressure of the canister 15 becomes greater than the atmospheric pressure by predetermined value. When opened, the atmospheric valve 19 allows gas (internal pressure) to be released from the canister 15 through an outlet pipe 20 while preventing a reversed flow.

A vapor control valve 21, provided in the canister 15, controls the flow rate of the vaporized fuel passing therethrough from the tank 1 to the canister 15. The control valve 21 opens in accordance with the difference between the interior pressure PT of the tank side of the valve 21, which includes the vapor line 14 (hereafter referred to as the tank pressure), and the interior pressure PC at the canister side of the valve 21 (hereafter referred to as the canister pressure). When opened, the control valve 21 allows vaporized fuel to flow into the canister 15 from the tank 1. In other words, the control valve 21 opens and allows vaporized fuel to enter the canister 15 when the value of the canister pressure PC becomes approximately the same as the atmospheric pressure and thus becomes smaller than the tank pressure PT. The control valve 21 also allows gas to flow toward the tank 1 from the canister 15 when the canister pressure PC becomes higher than the tank pressure PT.

A purge line 22, extending from the canister 15, is connected to the surge tank 10*a*. The canister 15 collects fuel introduced through the vapor line 14 and discharges only the residual gas, from which fuel components have been extracted, into the atmosphere through the outlet pipe 20 when the control valve 21 is opened. When the engine 9 is running, the negative pressure produced in the intake passage 10 acts on the purge line 22. This causes the fuel collected in the canister 15 to be purged into the intake passage 10 through the purge line 22. A purge control valve 23, provided in the purge line 22, adjusts the flow rate of fuel passing through the line 22 when required by the engine 9. The control valve 23 is an electromagnetic valve that includes a casing and a valve body (neither is shown). The valve body is moved by an electric signal (duty signal) to open the control valve 23. The opening of the control valve 23 is duty controlled.

The intake air temperature sensor 31, which is near the air cleaner 11, detects the temperature of the air drawn into the intake passage 10, or an intake air temperature THA, and transmits a signal based on the detected temperature value. The intake flow rate sensor 32, located near the air cleaner 11, detects the intake flow rate Q of the air drawn into the intake passage 10 and transmits a signal based on the detected flow rate. The opening amount TA of the throttle valve 12 is detected by a throttle sensor 33 arranged in the vicinity of the valve 12. The throttle sensor 33 transmits a signal based on the detected opening amount TA. A conventional idle switch (not shown) is incorporated in the throttle sensor 33. The idle switch is actuated when the throttle valve 12 is completely closed and sends an idle signal IDL indicating that the valve 12 is completely closed.

A fuel pressure sensor 34 provided in the delivery pipe 7 detects the pressure of the fuel delivered to the injectors 8, or the fuel pressure in the delivery pipe 7 (fuel pressure PF). The pressure sensor 34 sends a signal that corresponds to the value of the detected fuel pressure. The coolant temperature sensor 35, provided on the engine 9, detects the temperature of the coolant flowing through an engine 9, or a coolant temperature THW, and transmits a signal based on the detected temperature value. The revolution speed sensor 36, provided in the engine 9, detects the revolution speed of a crankshaft 9*a*, or the engine speed NE, and transmits a signal based on the detected speed. The oxygen sensor 37, provided in the exhaust passage 13, detects the oxygen concentration Ox of the exhaust gas passing through the exhaust passage 13 and transmits a signal based on the detected value.

An electronic control unit (ECU) 41 is connected to the sensor 31–37 and receives the signals transmitted from the sensors 31–37. The ECU 41 controls the fuel pump 4, the injectors 8 and the purge control valve 23 based on the input signals to control fuel injection including air-fuel ratio, fuel supply and fuel purge.

The fuel injection control referred to herein means the control of the time period during which each injector 8 is opened in accordance with the operating state of the engine 9 to control the amount of fuel injected from the injector 8 into the corresponding cylinder.

The air-fuel ratio control means adjustment of the amount of fuel to be injected from the individual injectors 8 to control the air-fuel ratio in the cylinder in accordance with the operating state of the engine 9.

The fuel supply control means adjustment of the amount of fuel discharged from the pump 4 in accordance with the operating state of the engine 9 to adjust the fuel pressure PF communicated to the injectors 8.

The fuel purge control referred to herein means the control of the amount of fuel to be purged from the canister 15 to the intake passage 10 by controlling the purge control valve 23 depending on the running state of the engine 9. The fuel to be purged to the intake passage 10 is combined with the regular gaseous mixture be formed based on the fuel injected from each injector 8, and the purge fuel makes the air-fuel ratio of the mixture deviate from the target value. In order to prevent the air-fuel ratio of the gaseous mixture from deviating from the target value due to the purge fuel, the ECU 41 performs air-fuel ratio control taking the amount of purge fuel into consideration.

Figure 2:
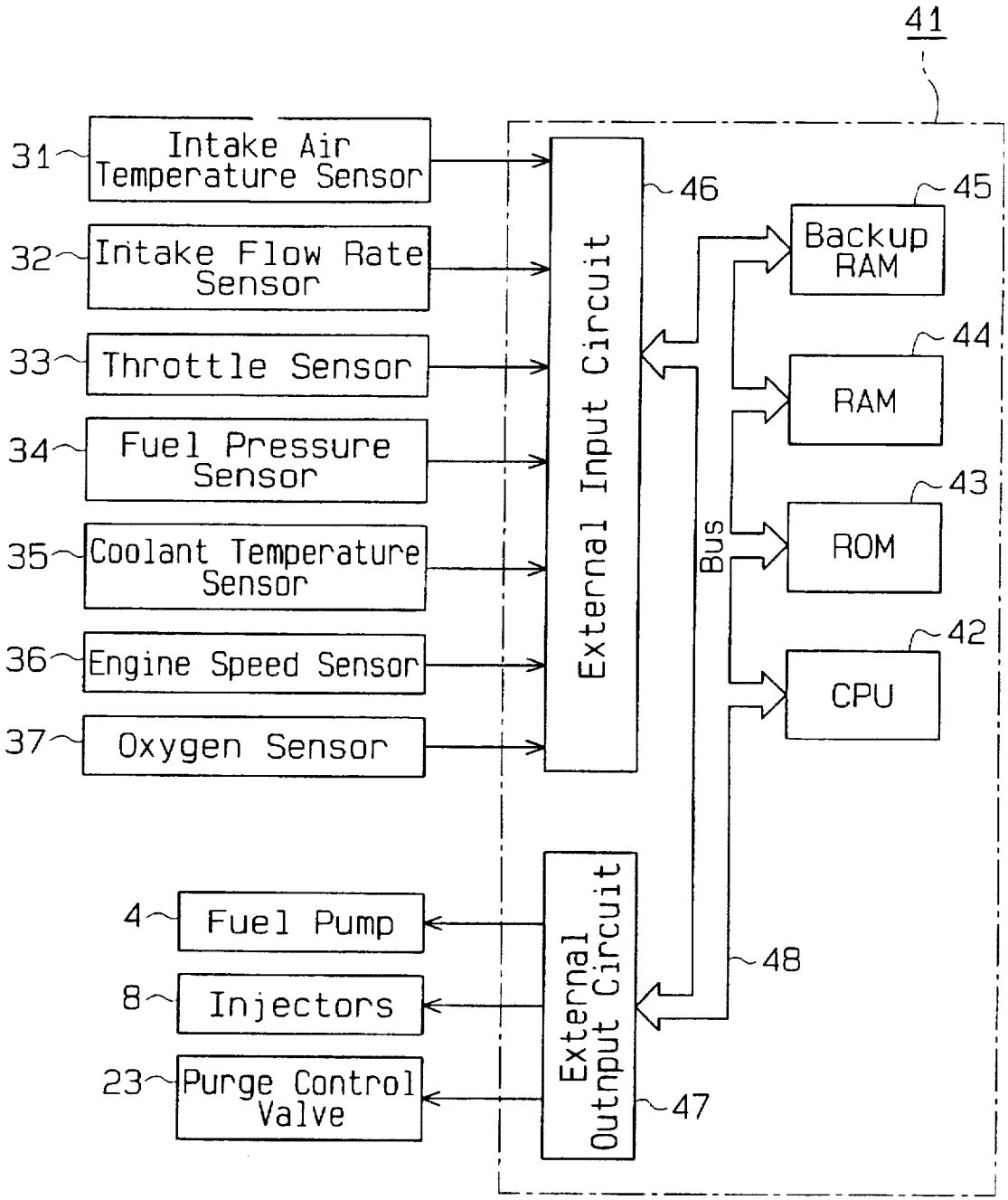
FIG. 2 is a block circuit diagram illustrating the structure of an electronic control unit.

As shown in the block diagram of FIG. 2, the ECU 41 includes a central processing unit (CPU) 42, a read-only memory (ROM) 43, a random access memory (RAM) 44 and a backup RAM 45. In the ECU 41, a logical computing circuit is formed by the CPU 42, the ROM 43, the RAM 44, the backup RAM 45, an external input circuit 46, an external output circuit 47, and a bus 48, which connects these parts to one another.

The ROM 43 stores a predetermined program related to the fuel injection control, air-fuel ratio control, fuel supply control and fuel purge control. The RAM 44 temporarily stores the computed results of the CPU 42. The backup RAM 45 holds prestored data. The external input circuit 46 includes a buffer, a waveform shaping circuit, a hard filter (a circuit having an electric resistor and a condenser), and an analog to digital (A/D) converter. The external output circuit 47 includes a drive circuit. The sensors 31–37 are connected to the external input circuit 46. The fuel pump 4, the injectors 8 and the purge control valve 23 are connected to the external output circuit 47. The detected signals of the sensors 31–37 sent via the external input circuit 46 are read by the CPU 42 as input values. The CPU 42 controls the fuel pump 4, the injectors 8 and the purge control valve 23.

Figure 3:
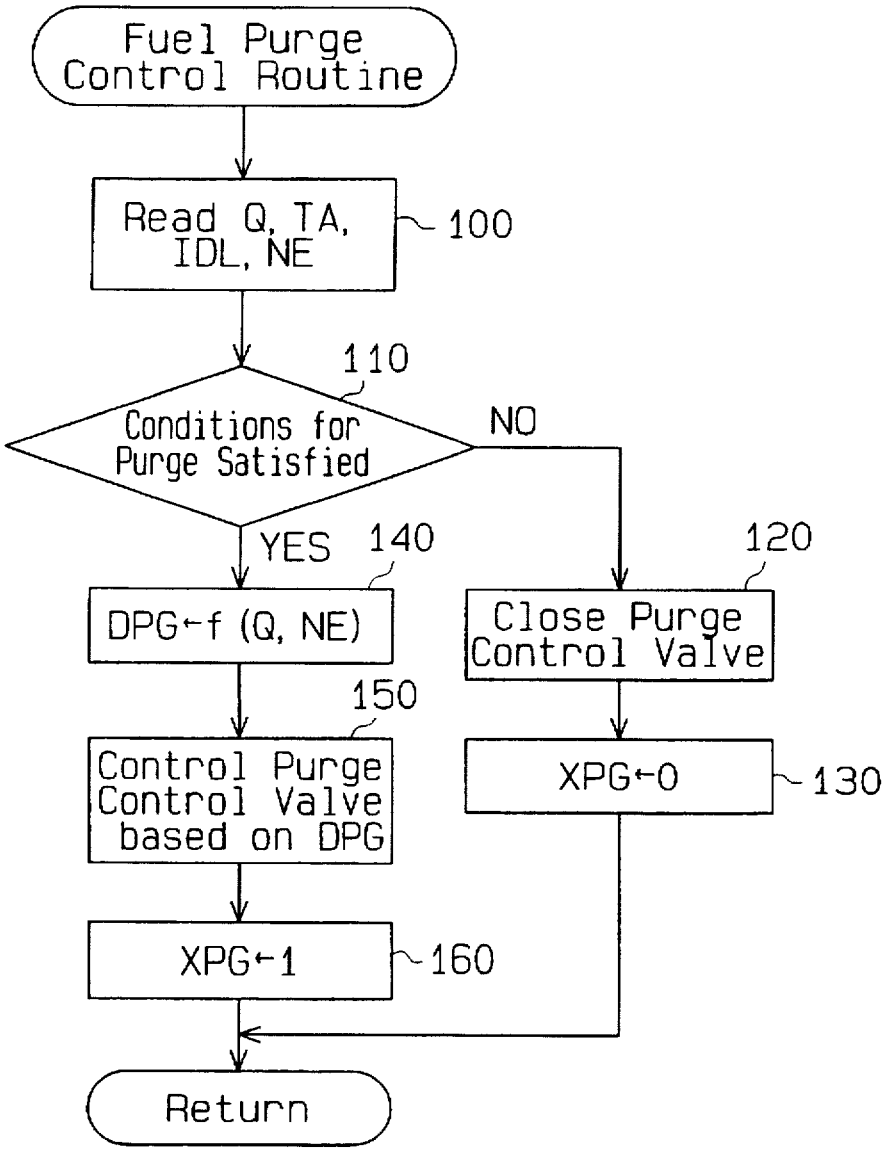
FIG. 3 is a flowchart showing a purge control routine.

The processing performed by the ECU 41 will now be described. FIGS. 3 illustrate a flowchart of a "fuel purge control routine" through which the fuel purge is performed. The ECU 41 periodically executes the routine every predetermined time period.

At step 100, the ECU 41 reads the values of the parameters that affect the running state of the engine 9, which are Q, TA, IDL, NE respectively detected by the sensors 32, 33, 36.

At step 110, the ECU 41 determines whether the conditions for the purging of fuel (purge conditions) have been fulfilled. Such conditions include the factors of whether both the values of the intake air amount Q and the engine speed NE are greater than predetermined values, respectively and whether sufficient negative pressure is produced in the surge tank 10*a*, and so on. If the purge conditions are not satisfied, the ECU 41 proceeds to step 120. If the purge conditions are satisfied, the ECU 41 proceeds to step 140.

At step 120, the ECU 41 closes the purge control valve 23 to cut off purging. At step 130, the ECU 41 sets a purge flag XPG to zero to indicate the fuel purging is cut off. The ECU 41 then temporarily terminates subsequent processing.

At step 140, the ECU 41 computes the value of a target duty ratio DPG based on the values of the intake air amount Q and the engine speed NE. The duty ratio DPG is a duty signal, which is supplied to the purge control valve 23 to adjust the opening amount of the purge control valve 23. ECU 41 computes the duty ratio DPG by referring to function data predetermined as a function of the intake air amount Q and the engine speed NE. The amount of fuel purging from the canister 15 into the intake air passage 10 is determined by the duty ratio DPG.

At step 180, the ECU 41 opens the purge control valve 23 based on the value of the duty ratio DPG to perform the fuel purging. At step 160, ECU 41 sets a purge flag XPG to zero to indicate that fuel purging is being performed. The ECU 41 then temporarily terminates subsequent processing.

Figure 4:
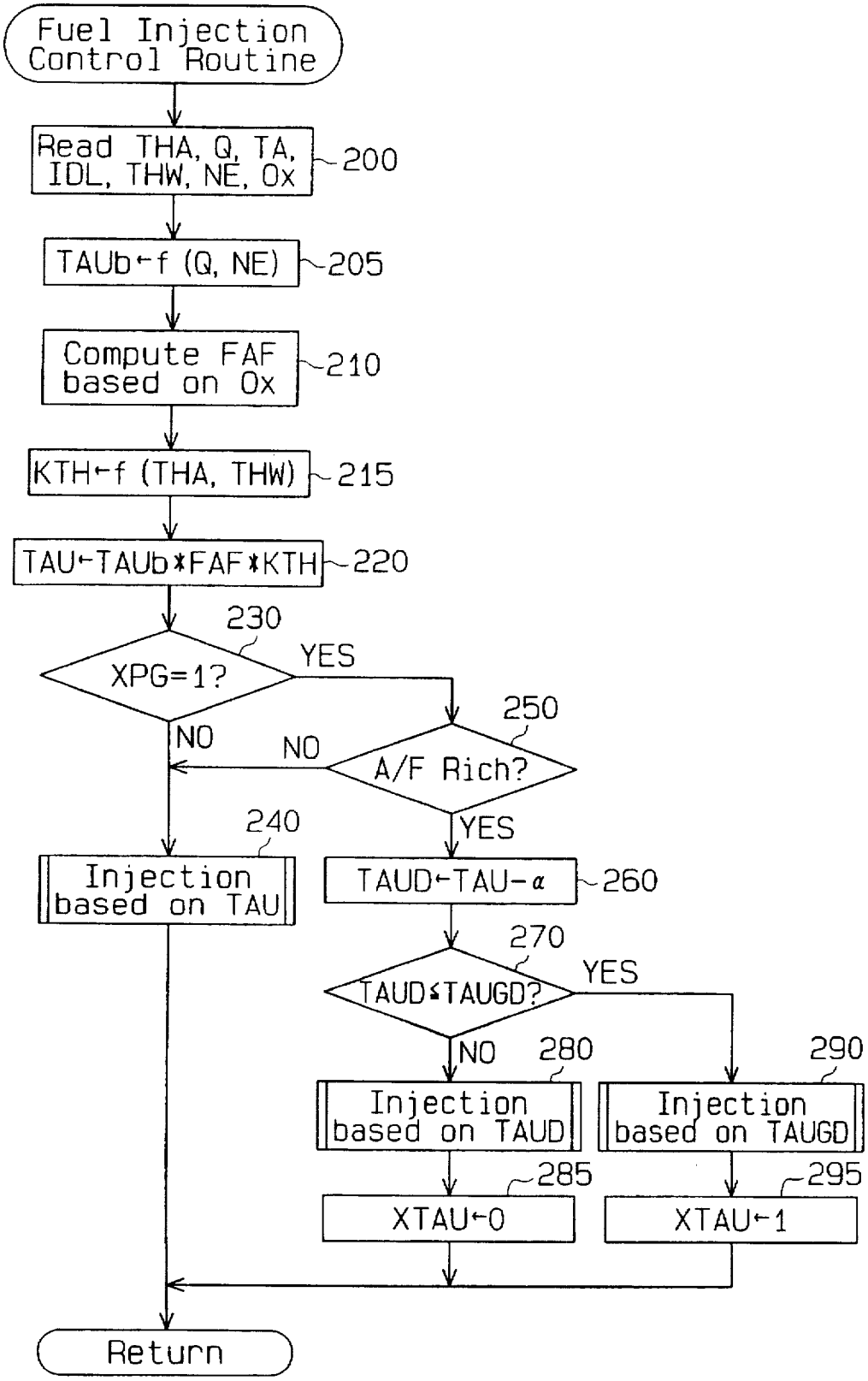
FIG. 4 is a flowchart showing a fuel injection control routine.

FIG. 4 is a flowchart illustrating the steps of a routine executed during the fuel injection control. The ECU 41 executes this routine every predetermined time interval in a cyclic manner when the engine 9 is running.

At step 200, the ECU 41 reads the values of the parameters that affect the running state of the engine 9, which are THA, Q, TA, IDL, THW, NE, Ox detected by the sensors 31–33, 35–37, respectively.

At step 205, the ECU 41 computes the basic injection amount TAUb based on the values of the intake air amount Q and the engine speed NE. The value of the basic injection amount TAUb is in units of time. The ECU 41 computes the value of the basic injection amount TAUb by referring to function data predetermined as a function of intake air amount Q and the engine speed NE.

At step 210, ECU 41 computes an air-fuel ratio correction coefficient FAF of the air-fuel mixture based on the value of the oxygen density Ox. For this compensation, the ECU 41 determines based on the signal from the oxygen density Ox whether the current air-fuel ratio A/F is richer or leaner than the theoretical optimum air-fuel ratio, and the ECU 41 computes the correction coefficient FAF so as to change the current air-fuel ratio A/F to match the theoretical optimum air-fuel ratio. Thus, the value of the correction coefficient FAF indicates whether the current air-fuel ratio A/F is rich or lean.

At step 215, the ECU 41 computes a temperature correction coefficient KTH based on the values of the intake air temperature THA and the coolant temperature THW. The ECU 41 computes the value of the correction coefficient KTH by referring to data predetermined as a function of the intake air temperature THA and the coolant temperature THW.

At step 220, ECU 41 computes a final injection amount TAU by multiplying the values of the basic injection amount TAUb, the air-fuel correction coefficient FAF and the temperature coefficient KTH. The final fuel injection amount TAU is in units of time and is used to determine the time period during which the injectors 8 are opened.

At step 230, the ECU 41 determines whether the fuel purge flag XPG is set at one. When the flag XPG is set at zero, the ECU 41 proceeds to step 240. When the flag XPG is set at one, the ECU 41 proceeds to step 250.

At step 230, the ECU 41 performs the fuel injection. More particularly, the ECU 41 determines whether the time for injecting fuel into each cylinder has come. The injection timing is determined based on the pulse signal that is output from the speed sensor 36 in relation to the engine speed NE. When it is determined that the injection time has come, the ECU 41 opens the injectors 8 for the required time period that corresponds with the value of the computed fuel injection amount TAU. The ECU 41 then temporarily terminates subsequent processing.

From step 230, the ECU 41 proceeds to step 250 and determines whether the air-fuel ratio A/F of the air-fuel mixture is rich by referring to the value of the correction coefficient FAF. When the effect of the fuel purge on the air-fuel mixture in the cylinders is relatively large, the air-fuel ratio A/F of the air-fuel mixture becomes rich. When the air-fuel ratio A/F is determined to match the theoretical optimal ratio or lean, the ECU 41 proceeds to step 240 described above, and then terminates this routine.

When the air-fuel ratio A/F is determined to be rich, the ECU 41 proceeds to step 260. At step 260, the ECU 41 subtracts a predetermined value alpha ($\alpha$) from the final injection amount TAU to compute a reduced injection amount TAUD. The predetermined value alpha is in units of time like the final injection amount TAU.

At step 270, the ECU 41 determines whether the value of the reduced injection amount TAUD is equal to or smaller than the lower limit injection amount TAUGD. The value of the lower limit TAUGD is set by considering the injection characteristic of the injectors 8. Concerning the characteristic of the injectors 8, as discussed earlier, the injection amount is approximately proportional to the injection time. However, the relationship between the injection amount and the injection time tends to become disproportional when the injection time is shorter than a certain time. The value of the lower limit amount TAUGD corresponds to the shortest injection time for which the relationship is proportional. Thus, the amount of fuel injected from the injectors 8 is proportional to the injection timing of the injectors 8 when the injectors 8 are opened based on the value that is greater than the lower limit amount TAUGD. In this case, a desired amount of fuel is injected from the injectors 8.

When the value of the reduced injection amount TAUD is greater than the lower limit amount TAUGD, the ECU 41 proceeds to step 280. At step 280, when it is determined that the injection time has come, the ECU 41 opens the injectors 8 for the required time period that corresponds to the value of the reduced injection amount TAUD.

At step 285, the ECU 41 sets an injection flag XTAU to zero to indicate that the proportional relationship between the injection time and the injection amount is controlling. The ECU 41 then temporarily terminates subsequent processing.

On the other hand, when the value of the reduced injection amount TAUD is equal to or smaller than the lower limit amount TAUGD, the ECU 41 proceeds to step 290. At step 290, when it is determined that the injection time has come, the ECU 41 opens the injectors 8 for the required time period that corresponds to the value of the lower limit amount TAUGD.

At step 295, the ECU 41 sets a injection flag XTAU to one to indicate that the proportional relationship between the injection time and the injection amount may not be relied on. The ECU 41 then temporarily terminates subsequent processing.

Figure 5:
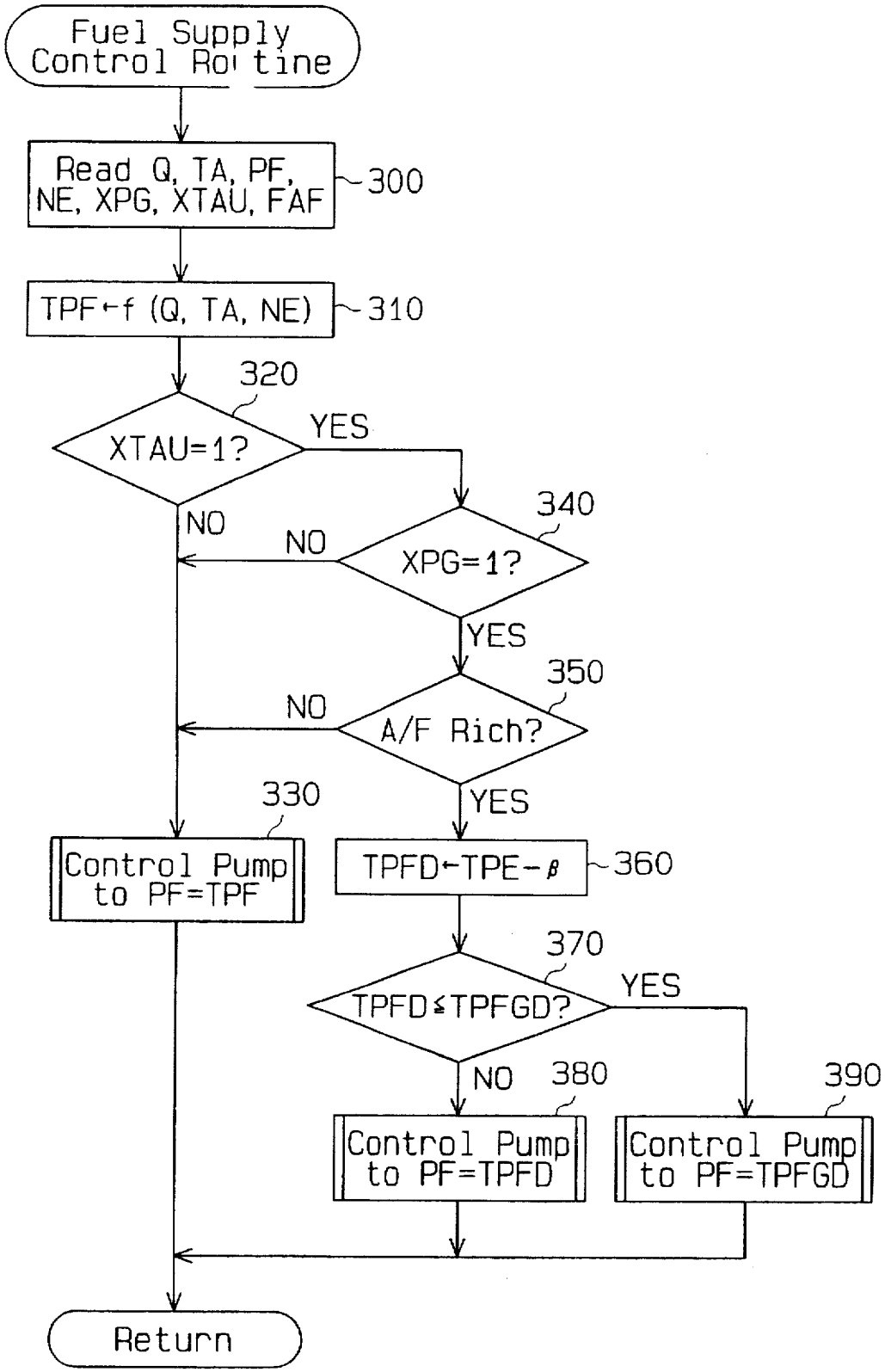
FIG. 5 is a flowchart showing a fuel supply control routine.

FIG. 5 is a flowchart illustrating the steps of a routine executed during the fuel supply control. The ECU 41 executes this routine every predetermined time interval in a cyclic manner when the engine 9 is running.

At step 300, the ECU 41 reads the values of the parameters Q, TA, PF, NE, respectively detected by the sensors 32–34, 36. Also, the ECU 41 reads the values of the purge flag XPG, the injection flag XTAU and the correction coefficient FAF that are set in the above routines.

At step 310, the ECU 41 computes the value of a target fuel pressure TPF based on the values of the intake air amount Q, the throttle opening amount TA and the engine speed NE. ECU 41 computes the target fuel pressure TPF by referring to data predetermined as a function of the intake air amount Q, the opening amount TA and the engine speed NE.

At step 320, the ECU 41 determines whether the injection flag XTAU is set at one. When the flag XTAU is set at zero, the ECU 41 proceeds to step 330. When the flag XTAU is set at one, the ECU 41 proceeds to step 340.

At step 330, the ECU 41 controls the pump 4 to match the value of the actual fuel pressure PF with the value of the target fuel pressure TPF. The ECU 41 then temporarily terminates subsequent processing.

From step 320, the ECU 41 proceeds to step 340 and determines whether the purge flag XPG is set at one. When the flag XPG is set at zero, the ECU 41 performs the process of step 330 and then temporarily terminates subsequent processing. When the flag XPG is set at one, the ECU 41 proceeds to step 350.

At step 350, the ECU 41 determines whether the air-fuel ratio A/F of the air-fuel mixture is rich based on the value of the correction coefficient FAF. When the fuel ratio determined to be rich, the ECU 41 proceeds to step 360. When the air-fuel ratio A/F is not rich, the ECU 41 performs the process of step 330 and then terminates this routine.

At step 360, the ECU 41 subtracts a predetermined value beta (β) from the target fuel pressure TPF to compute a reduced target fuel pressure TPFD. The predetermined value beta is set appropriately in accordance with the type of the pump used.

At step 370, the ECU 41 determines whether the value of the reduced target fuel pressure TPFD is equal to or smaller than lower limit fuel pressure TPFGD. The value of the lower limit pressure TPFGD is set by considering the discharge characteristic of the pump 4. Concerning the characteristic of the pump 4, the discharge amount of fuel from the pump 4 is approximately proportional to the rotational speed of the motor incorporated in the pump 4. However, the relationship between the discharge amount and the rotational speed tends to become disproportional when the rotational speed is lower than a certain speed. The value of the lower limit pressure TPFGD corresponds to the lowest speed of the motor at which the relationship is proportional. Thus, the discharge amount of fuel from the pump 4 is proportional to the rotational speed of the motor when the pump 4 is controlled based on the value that is greater than the lower limit pressure TPFGD. In this case, a desired amount of fuel is discharged from the pump 4.

When the value of the reduced target pressure TPFD is greater than the lower limit pressure TPFGD, the ECU 41 proceeds to step 380. At step 380, the ECU 41 controls the pump 4 to match the detected fuel pressure PF with the reduced target fuel pressure TPFD and then terminates this routine.

On the other hand, when the reduced target pressure is equal to or smaller than the lower limit pressure TPFGD, the ECU 41 proceeds to step 390. At step 390, the ECU 41 controls the pump 4 to match the detected fuel pressure PF with the lower limit fuel pressure TPFGD and then terminates this routine.

Figure 6:
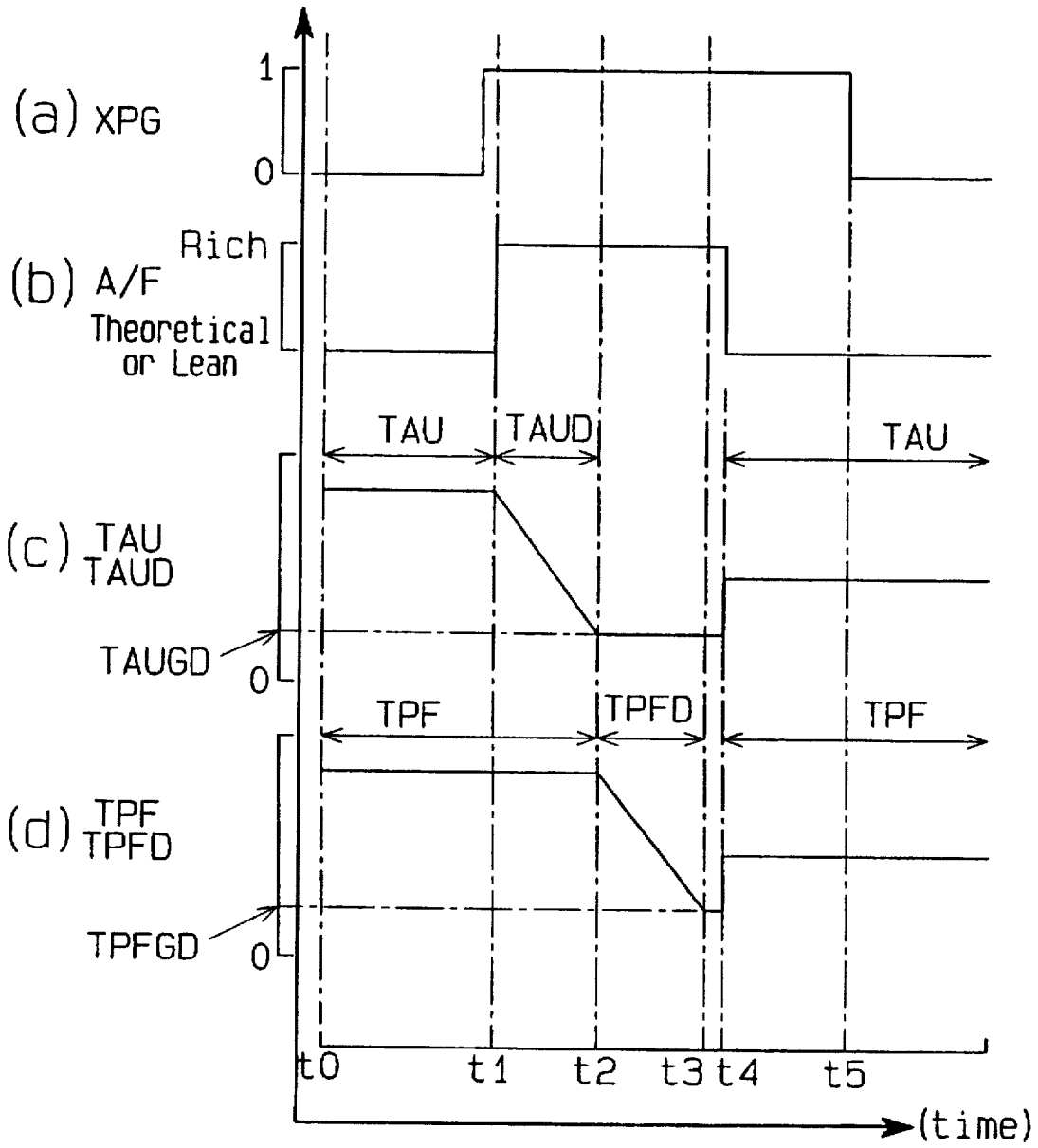
FIG. 6 is a time chart illustrating the behavior of various parameters.
Figure 7:
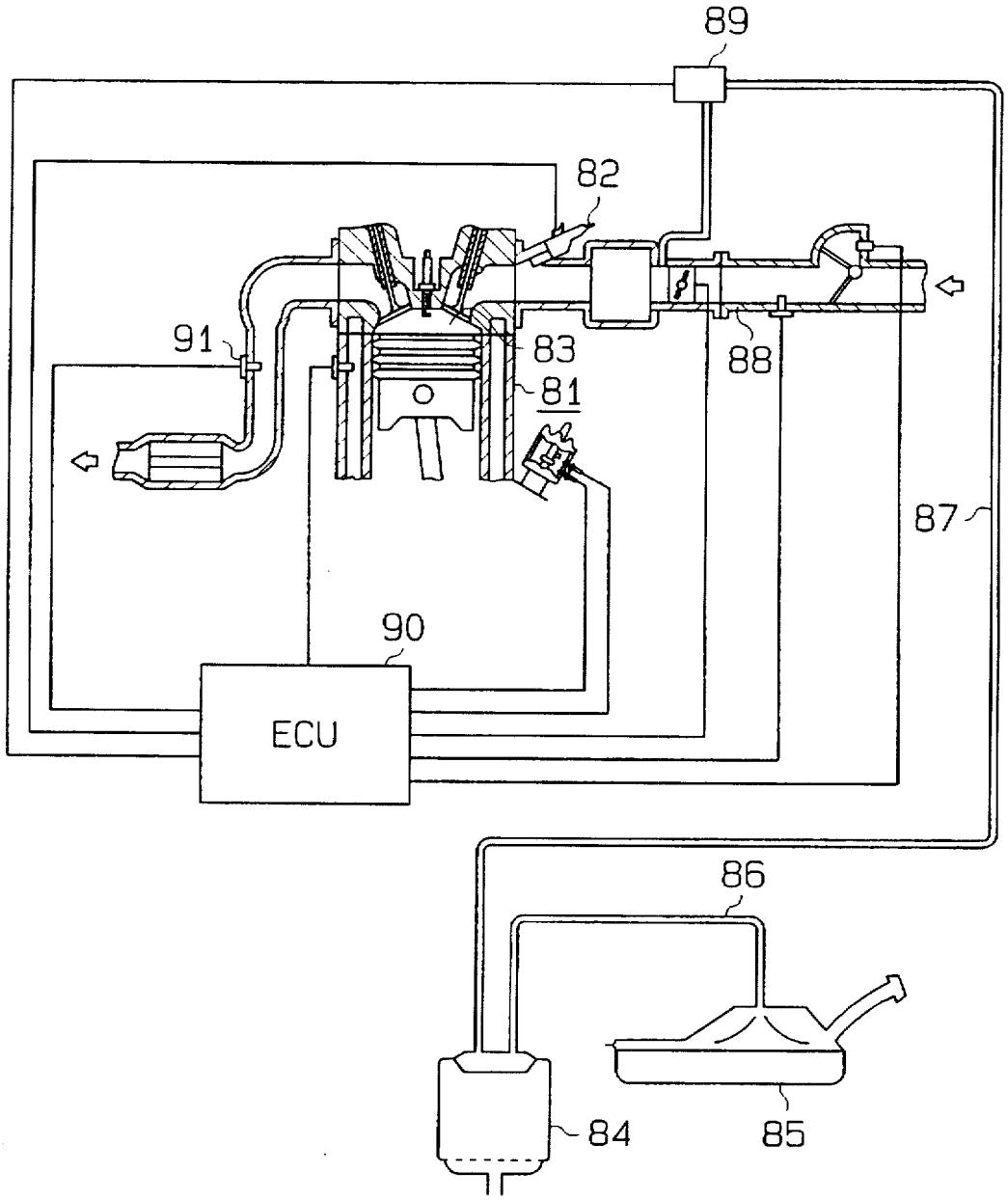
Fig.7 (Prior Art)
FIG. 7 is a diagrammatic view showing a prior art fuel vapor treating apparatus.

Exemplary behaviors of various parameters XPG, A/F, TAU (TAUD) and TPF (TPFD) obtained by the procedures described above are explained in accordance with the timing chart shown in FIG. 6.

At the time t0, no fuel purge is executed, and the purge flax XPG indicates "zero" where the detected air-fuel ratio A/F matches the theoretical optimal air-fuel ratio value or is lean. In this state, the fuel injection amount TAU and the target fuel pressure TPF show corresponding values depending on the running state of the engine 9, and these values are employed for controlling the injectors 8 and the pump 4.

When fuel purge is started, the purge flag XPG indicates "one". At the time t1, immediately after where the air-fuel ratio A/F shifts to rich, the fuel injection amount TAU is subtracted, and calculation of the reduced injection amount TAUD is started. The value of this reduced injection amount TAUD is used for controlling the injectors 8. Subsequently, since the air-fuel ratio A/F of the gaseous mixture becomes rich due to the influence of the purge fuel, the reduced injection amount TAUD is reduced continuously. The reduction in the reduced injection amount TAUD reduces the valve opening time of the injectors 8 to reduce the amount of fuel to be injected from each injector 8.

At the time t2, when the value of the reduced injection amount TAUD reaches the value of the lower limit injection amount TAUGD, reduction of the reduced injection amount TAUD is terminated considering that the injection characteristics of the injectors 8 are in the disproportional range. Then, the value of the reduced injection amount TAUD is maintained at the value of lower limit injection amount TAUGD. In other words, the valve opening time of each injector 8 is maintained at the smallest value within the proportional range of the injection characteristics.

When reduction of the reduced injection amount TAUD is terminated, the target fuel pressure TPF is reduced, and calculation of the reduced fuel pressure TPFD is started. The value of the reduced fuel pressure TPFD is used for controlling the pump 4. Since the air-fuel ratio A/F is still rich under the influence of the purge fuel, reduction of the reduced fuel pressure TPFD is continued. The reduction of the reduced fuel pressure TPFD reduces the discharge amount of the pump 4 and the fuel pressure at the injectors 8. The reduction of the fuel pressure further reduces the amount of fuel to be injected from each injector 8.

At the time t3, when the value of the reduced fuel pressure TPFD reaches the lower limit fuel pressure TPFGD, reduction of the reduced fuel pressure TPFD is terminated considering deterioration of discharge characteristics of the pump 4. Subsequently, the value of the reduced fuel pressure TPFD is maintained at the value of the lower limit fuel pressure TPFGD. In other words, the discharge amount of the pump 4 is maintained at the lowest value within proportional the range of the discharge characteristics.

The influence of the purge fuel on the gaseous mixture is moderated by the reduction in the fuel amount to be injected from the injectors 8 depending on the purging of fuel. At the time t4, the air-fuel ratio A/F shifts to the theoretical optimal air-fuel ratio or becomes lean. Simultaneously, the fuel injection amount TAU and the target fuel pressure TPF are calculated depending on the running state of the engine 9 respectively, and the thus calculated values are used for controlling the injectors 8 and the pump 4.

At the time t5, fuel purging is terminated, and thus the indication of the purge flag XPG is changed to "one".

As described above, the pump 4 is employed to pressurize and send fuel to the injectors 8 from the tank 1. The fuel is supplied to the cylinders of the engine 9 when injected through the injectors 8.

The ECU 41 performs the fuel injection control and fuel supply control to coincide the air-fuel ratio A/F of the air-fuel mixture with the theoretical optimum air-fuel ratio.

During the fuel injection control, the ECU 41 computes the value of the fuel injection amount TAU, which is necessary to operate the engine 9, based on parameters that include the values of the parameters THA, Q, TA, THW, NE and Ox. The ECU 41 controls the amount of fuel injected into each cylinder by controlling the injectors 8 based on the computed value of the fuel injection amount TAU. The ECU 41 obtains the time period for opening the injectors 8 based on the fuel injection amount TAU. In other words, the ECU 41 adjusts the time period during which each injector 8 is opened to control the amount of fuel injected from the injectors 8.

During the fuel supply control, the ECU 41 computes the target pressure TPF of the fuel pressure PF at the injectors 8 based on the values of the parameters Q, TA, NE that are related to the operating state of the engine 9. The ECU 41 controls the amount of fuel discharged from the pump 4 so as to coincide the value of the actual fuel pressure PF, which is detected by the pressure sensor 34, with the computed target pressure TPF.

In this manner, the amount of fuel supplied to each cylinder through the associated injector 8 is determined by the cooperation between the adjustment of the fuel pressure PF at the injectors 8 and the adjustment of the time period during which each injector 8 is opened. Thus, the amount of injected fuel is adjusted in accordance with the operating state of the engine 9.

In the fuel vapor treating device, the vaporized fuel produced in the tank 1 is collected in the canister 15 without releasing the fuel into the atmosphere. During purge control, the ECU 41 opens purge control valve 23 by a required degree when the purge conditions are satisfied. The fuel vapor, which was temporarily adsorbed in the canister 15, is purged to the intake passage 10 through the purge line 22. The purged fuel is supplied to the engine 9 for combustion in addition to the fuel injected by the injectors 8.

The air-fuel ratio control should be carried out taking the amount of purge fuel into consideration. When fuel is purged, the ECU 41 first reduces the calculated fuel injection amount TAU. That is, the ECU 41 reduces the valve opening time of the injectors 8. Thus, the amount of fuel to be injected from each injector 8 is reduced. Therefore, the amount of fuel to be supplied to the engine 9 is somewhat controlled so that it is not excessive in view of the supply of purge fuel.

Subsequently, when the reduced valve opening time, i.e., the value of the reduced injection amount TAUD, reaches the lower limit injection amount TAUGD, the ECU 41 reduces the calculated target fuel pressure TPF. That is, the ECU 41 reduces the discharge amount of the pump 4. Thus, the fuel pressure PF at the injectors 8 is reduced, and further the amount of fuel to be injected from each injector 8 is thus further reduced. The amount of fuel supplied to the engine 9 is therefore controlled in consideration of the supply of purge fuel to avoid excessive richness.

This not only prevents the performance of the engine from deteriorating but also prevents an unnecessary increase in harmful emissions.

A fine adjustment of the fuel injection amount, which cannot be achieved accurately merely by reducing the valve opening time of each injector 8, can be achieved appropriately by reducing the fuel pressure PF. This compensates for the disproportional range in the injection characteristics of the injectors 8 and enables more appropriate adjustment of the amount of fuel to be injected from the injectors 8. Consequently, the air-fuel ratio A/F of the gaseous mixture is adjusted with high accuracy. Further, the fine adjustment of the fuel injection amount increases the opportunities to where fuel purge fuel and thus enables more efficient use of the fuel vaporizing apparatus.

During purging, the amount of fuel injected by the injectors 8 is reduced. This improves the fuel economy of the engine 9.

The rotational speed of the motor in the pump 4 is reduced to decrease the fuel pressure PF when the purging is performed. Thus, the amount of heat emitted from the pump 4 is reduced. This reduces the temperature in the tank 1. This reduces the amount of vaporized fuel that is generated in the tank 1.

The pump 2 is controlled so as to coincide the detected fuel pressure PF with the target pressure TPF, TPFD, TPFGD. Thus, the actual fuel pressure PF is immediately adjusted so as to coincide with the target pressure TPF, TPFD, TPFGD.

The basic injection amount TAUb used to compute the fuel injection amount TAU is corrected by the temperature correction coefficient KTH. This allows computation of a fuel injection amount TAU that appropriately corresponds to the temperature of the engine 9.

Since this embodiment does not employ a pressure regulator and a return line, the size of the entire apparatus is minimized.

Although only one embodiment of the present invention has been described herein, it should be apparent to those skilled in the art that the present invention may be embodied in many other specific forms without departing from the spirit or scope of the invention. Particularly, it should be understood that the invention may be embodied in the following forms.

(1) When fuel is to be purged, the fuel pressure PF to be supplied to each injector 8 may first be reduced, and then the valve opening time of each injector 8 may be reduced to reduce the amount of fuel to be injected from the injectors 8.

(2) When purging conditions are established, fuel may be purged by opening the purge control valve 23 at a fixed valve position.

(3) In the preferred and illustrated embodiment, the fuel pressure PF is detected by the pressure sensor 34 arranged in the delivery pipe 7. However, the fuel pressure PF may be detected by arranging a pressure sensor in the fuel line 5.

Therefore, the present figures and description are to be considered as illustrative and not restrictive, and the invention is not to be limited to the details given herein, but may be modified within the scope and equivalence of the appended claims.

What is claimed is:

1. An apparatus for supplying a fuel to an internal combustion engine, the engine having:

a fuel injector that is selectively opened and closed based on the running condition of the engine;

a pump for supplying fuel from a fuel tank to the injector; and a treating device for collecting fuel vapor formed in the fuel tank to supply it to the engine, wherein the amount of fuel injected from the injector is adjusted depending on the running condition of the engine, the fuel supplying comprising:

a running condition detector for detecting the running condition of the engine;

an injector controller for adjusting an opening time period of the injector depending on the detected running condition to control the amount of fuel to be injected from the injector;

a pump controller for adjusting the amount of fuel to be discharged from the pump depending on the detected running condition to control the pressure of the fuel to be pumped to the injector;

a pump controller for adjusting the amount of fuel to be discharged from the pump depending on the detected running condition to control the pressure of the fuel to be pumped to the injector;

an injection corrector for reducing the opening time period of the injector to reduce the amount of fuel to be injected from the injector;

a fuel pressure corrector for reducing the amount of fuel to be discharged from the pump so as to further reduce the amount of fuel to be injected from the injector and a determiner for determining whether fuel vapor is being supplied by the treating device to the engine, and wherein the injection corrector reduces the opening time period of the injector only when the determiner determines that fuel vapor is being supplied to the engine;

wherein the opening time period of the injector is reduced to a predetermined lower limit period by the injection corrector, and the fuel pressure corrector reduces the amount of fuel to be discharged from the pump only when the opening time period of the injector is maintained at the predetermined lower limit period.

2. The apparatus according to claims 1, wherein the amount of fuel injected from the injector is generally proportional to the opening time period of the injector except in a range of opening time periods shorter than a certain predetermined open time period, and wherein the injection corrector reduces the valve opening time period of the injector to correct the amount of fuel injected within a range of time periods where the relationship between the valve opening time period and the amount of fuel injected from the injector is proportional.

3. The apparatus according to claim 2, wherein the certain predetermined period is the shortest valve opening time period within the range where the relationship between the valve opening time period and the amount of fuel to be injected from the injector is proportional.

4. The apparatus according to claim 3, wherein when the running condition detector includes an air-fuel ratio detector for detecting the air-fuel ratio of the air-fuel mixture supplied to the engine, and wherein the injection corrector reduces the valve opening time period of the injector when the detected air-fuel ratio is richer than a theoretical optimum air-fuel ratio.

5. The apparatus according to claim 4, wherein the fuel pressure corrector reduces the amount of fuel to be discharged from the pump only when the detected air-fuel ratio of the air-fuel mixture is richer than the theoretical optimum air-fuel ratio.

6. The apparatus according to claim 5, wherein the injector controller controls the opening time period of the injector such that the detected air-fuel ratio substantially coincides with the theoretical optimum air-fuel ratio.

7. The apparatus according to claim 5, further comprising a first computer for computing a target fuel pressure depending on the detected running condition of the engine, wherein the running condition detector includes a pressure detector for detecting the pressure of the fuel supplied to the injector, and wherein the fuel pressure controller controls the amount of fuel to be discharged from the pump so that the detected fuel pressure substantially coincides with the target fuel pressure.

8. The apparatus according to claim 7, wherein the fuel pressure corrector reduces the fuel pressure of the fuel supplied to the injector to a predetected lower limit value by reducing the amount of fuel to be discharged from the pump.

9. The apparatus according to claim 5, wherein the running condition detector includes a temperature detector for detecting the temperature of the engine, and wherein the injector controller controls the opening time period of the injector depending on the detected temperature of the engine.

10. The apparatus according to claim 1, wherein the engine has an intake passage, and wherein the treating device includes a canister for collecting fuel vapor formed in the tank, a vapor line for connecting the canister with the tank, a purge line for connecting the intake passage and the canister to supply the collected fuel vapor to the intake passage, a purge control valve provided in the purge line and a purge controller for controlling the purge control valve to adjust the amount of fuel vapor supplied from the canister to the intake passage.

11. The apparatus according to claim 10, wherein the treating device has a vapor control valve located in the vapor line, and wherein the vapor control valve is opened when the internal pressure of the tank is greater than the internal pressure of the canister to allow flow of fuel vapor from the tank to the canister.

12. The apparatus according to claim 1, further comprising a fuel line for connecting the pump with the injector to form a returnless fuel system wherein all the fuel discharged from the pump is supplied through the injector to the engine.

13. The apparatus according to claim 12, further comprising a first computer for computing a target fuel pressure depending on the detected running condition of the engine, wherein the running condition detector includes a pressure detector for detecting the pressure of fuel supplied to the injector, and wherein the fuel pressure controller adjusts the amount of fuel to be discharged from the pump such that the detected fuel pressure substantially coincides with the target fuel pressure.

* * * * *